US007063095B2

(12) United States Patent
Barcay et al.

(10) Patent No.: US 7,063,095 B2
(45) Date of Patent: Jun. 20, 2006

(54) DRAIN WASHING APPARATUS

(75) Inventors: S. John Barcay, Burnsville, MN (US); Jamie W. Lerbs, Mendota Heights, MN (US); John A. Mathisrud, Mendota Heights, MN (US); Thomas L. Harris, Eden Prairie, MN (US)

(73) Assignee: Ecolab Inc., St. Paul, MN (US)

( * ) Notice: Subject to any disclaimer, the term of this patent is extended or adjusted under 35 U.S.C. 154(b) by 288 days.

(21) Appl. No.: 10/174,411

(22) Filed: Jun. 17, 2002

(65) Prior Publication Data

US 2003/0230325 A1 Dec. 18, 2003

(51) Int. Cl.
*B08B 3/02* (2006.01)

(52) U.S. Cl. ..... 134/166 R; 134/169 R; 134/172; 134/182; 134/198

(58) Field of Classification Search ..... 134/166 R, 134/169 R, 169 A, 172, 175, 177, 182, 198, 134/166 C, 169 C; 4/255.01–255.11
See application file for complete search history.

(56) References Cited

U.S. PATENT DOCUMENTS

| | | | | | |
|---|---|---|---|---|---|
| 536,770 | A | * | 4/1895 | Vinter | 285/191 |
| 994,442 | A | * | 6/1911 | Coles | 134/166 C |
| 1,013,175 | A | * | 1/1912 | Jones | 134/166 C |
| 1,173,710 | A | * | 2/1916 | Crocker et al. | 134/166 C |
| 1,528,081 | A | * | 3/1925 | Schermerhorn et al. | 134/166 C |
| 1,647,804 | A | * | 11/1927 | Laney | 285/244 |
| 1,760,704 | A | * | 5/1930 | Lindstrom | 134/166 C |
| 1,988,198 | A | * | 1/1935 | German | 4/255.04 |
| 2,009,398 | A | * | 7/1935 | Green | 4/255.08 |
| 2,055,801 | A | * | 9/1936 | Perry | 4/255.08 |
| 2,066,773 | A | * | 1/1937 | Felice | 4/255.05 |
| 2,197,716 | A | * | 4/1940 | Whitaker | 4/255.08 |
| 2,461,656 | A | * | 2/1949 | Norman | 134/166 C |
| 2,570,546 | A | * | 10/1951 | Hamlett | 4/255.08 |
| 2,626,405 | A | * | 1/1953 | Keith | 4/255.04 |
| 2,697,842 | A | * | 12/1954 | Meyer | 4/255.06 |
| 3,023,428 | A | * | 3/1962 | Otteson | 4/255.04 |
| 3,031,148 | A | * | 4/1962 | Holdren | 239/559 |
| 3,079,937 | A | * | 3/1963 | Tooper et al. | 134/166 R |
| 3,130,421 | A | * | 4/1964 | Quinlan | 4/255.11 |
| 3,172,415 | A | * | 3/1965 | Maushund | 134/93 |
| 3,537,113 | A | * | 11/1970 | Elzner | 4/255.05 |
| 3,605,135 | A | * | 9/1971 | Tan | 4/255.04 |
| 3,608,098 | A | * | 9/1971 | Andrisani | 4/255.04 |
| 3,802,449 | A | * | 4/1974 | Mulinex | 134/166 C |
| 3,952,341 | A | * | 4/1976 | Cain | 4/255.01 |
| 4,047,253 | A | * | 9/1977 | Petterson | 4/255.01 |
| 4,141,090 | A | * | 2/1979 | Rowan | 4/255.04 |
| 4,208,219 | A | * | 6/1980 | Etscheid | 134/57 R |
| 4,238,860 | A | * | 12/1980 | Dixon | 4/255.08 |
| 4,320,539 | A | * | 3/1982 | Li | 4/255.06 |

(Continued)

FOREIGN PATENT DOCUMENTS

DE 31 11 883 A1 10/1982

(Continued)

*Primary Examiner*—Frankie L. Stinson
(74) *Attorney, Agent, or Firm*—Merchant & Gould P.C.

(57) ABSTRACT

The present invention relates to apparatus for washing drains. The apparatus includes a support and a nozzle, which are adapted and configured to convey fluid to and to wash a drain. Typically, the apparatus includes a wand as the support and a ball or head as the nozzle. The apparatus can also include a fluid retainer, which can keep the dispensed fluid in and/or near the drain.

34 Claims, 6 Drawing Sheets

U.S. PATENT DOCUMENTS 4,447,917 A * 5/1984 Walter ..... 4/255.09
4,458,706 A * 7/1984 Scholes ..... 134/166 R
4,606,364 A 8/1986 Tash
4,674,137 A 6/1987 Girse
4,756,480 A * 7/1988 Fish ..... 4/255.06
4,962,778 A * 10/1990 Driskill ..... 134/169 C
5,099,527 A * 3/1992 Roose ..... 4/255.11
5,193,245 A * 3/1993 Brzoska ..... 15/330
5,261,128 A * 11/1993 Davenport ..... 4/255.05
5,353,442 A 10/1994 Rotter
5,384,918 A * 1/1995 Leighton et al. ..... 4/255.05
5,497,514 A * 3/1996 Miller ..... 4/255.04
5,537,694 A * 7/1996 Davenport ..... 4/255.05
5,546,613 A * 8/1996 Davenport ..... 4/255.05
5,787,516 A * 8/1998 Davenport ..... 4/255.04
5,984,555 A * 11/1999 Samad ..... 401/176
6,295,659 B1 * 10/2001 Sandness ..... 4/255.01
6,623,201 B1 * 9/2003 Brumlik ..... 401/279
6,907,622 B1 * 6/2005 Rasaei et al. ..... 4/255.06

FOREIGN PATENT DOCUMENTS

DE 297 12 103 * 10/1997
DE 297 17 048 U1 2/1998

* cited by examiner

DRAIN WASHING APPARATUS

FIELD OF THE INVENTION

The present invention relates to apparatus for washing drains.

BACKGROUND OF THE INVENTION

Although many apparatus exist for clearing or unclogging (cleaning) drains, washing drains presents a different problem. Drains can be home to undesirable microbes, insects, or insect eggs and larvae. Clearing or unclogging (cleaning) a drain will not prevent growth of these undesirables in the drain. Currently, washing a drain can do more harm than good. Drain washing with high pressure water or brushes can splash, spray, or aerosolize drain soils or undesirable microbes, which spreads them to the surroundings. This undesirable spreading can be referred to as "over-spray". Thus surroundings of the drain that have been cleaned can be dirtied by drain soils and undesirable microbes. There remains a need for more effective apparatus for washing drains.

SUMMARY OF THE INVENTION

The present invention relates to drain washing apparatus. The drain washing apparatus includes a support and a nozzle, which are adapted and configured to convey fluid to and to wash a drain. Typically, the present apparatus includes a wand as the support and a ball or head as the nozzle. The present apparatus can also include a fluid retainer, which can keep the dispensed fluid in and/or near the drain.

In an embodiment, the drain washing apparatus includes a ball and a wand. The wand has a proximal end and a distal end. The ball can be coupled to the wand at the distal end. Together, the wand and ball can be adapted and configured to provide fluid flow through or along the wand and through the ball. The ball can be adapted and configured to nest with a drain. In embodiment, the present apparatus includes a wand, a ball, and a shield. The shield can be coupled to the wand at the distal end and proximal of the ball.

In an embodiment, the drain washing apparatus includes a head, a shield, and a wand. The wand has a proximal end and a distal end. The head can be coupled to the wand at the distal end. Together, the wand and head can be adapted and configured to provide fluid flow through or along the wand and through the head. The shield can be coupled to the wand at the distal end and proximal of the ball. The shield can extend radially from the wand and have a radial dimension greater than a diameter of a drain mouth.

BRIEF DESCRIPTION OF THE FIGURES

The present invention may be better understood with reference to the FIGS. These FIGS are intended to be representative of specific embodiments of the invention, and are not intended as limiting the scope of the invention.

FIG. 5 illustrates a ball with a round cross section nesting with an opening of a cylinder, such as a drain.

DETAILED DESCRIPTION OF THE INVENTION

Definitions

Figures 1A, 1B:
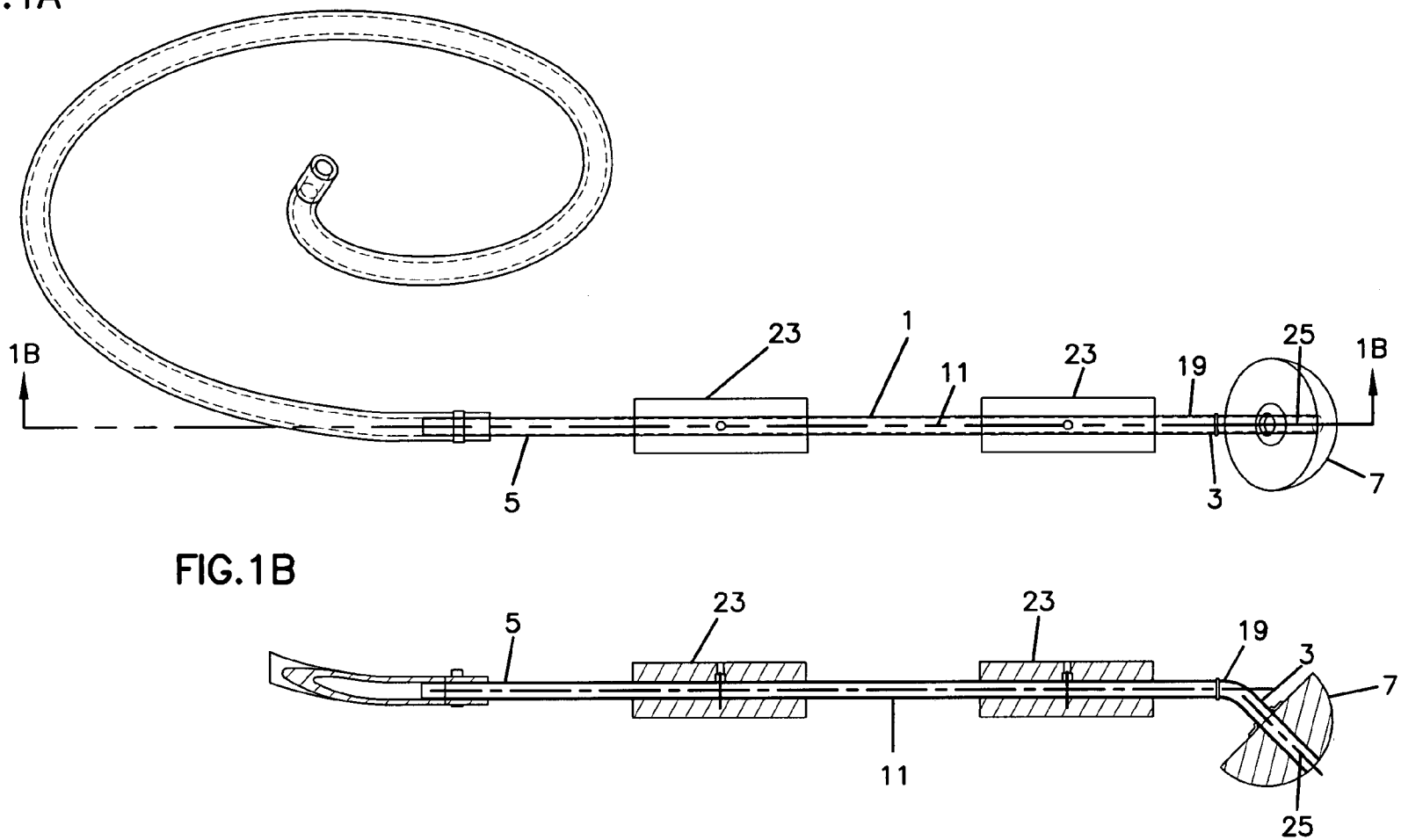
FIG. 1 illustrates an embodiment of a drain washing apparatus according to the present invention and including a wand and a ball.

As used herein, terms describing shapes and surfaces, such as "sphere", "elliptical solid", "circular" and the like, include those ideal shapes but also those ideal shapes as realized in the real world. That is, these terms include deviations from these shapes as they are embodied in a manufactured component of an apparatus. Typical manufacturing tolerances and use in the field can cause deviations from the ideal, which are encompassed in the present use of terms describing shapes.

As used herein, the term "drain" refers those portions of a drain above and into the trap and including the mouth of the drain and the drain cup. As used herein, "drain cup" refers to an opening around and bigger than the mouth of the drain. As used herein, "drain mouth" and like terms refer to the opening of the drain through which fluid flows directly into the pipe leading away.

As used herein, "drain washing" refers to washing one or more of the surfaces of a drain above and into the trap. Drain washing does not refer to unclogging or clearing a drain trap or pipe of any solid or viscous residue that restricts flow of water through the trap and down the drain. Drain washing can include applying cleaning composition, antimicrobial composition, or pest control composition to the drain.

Any term modified by "about" can also be used to describe the present invention when not modified by "about".

Drain Washing Apparatus

The present invention relates to apparatus for washing a drain. The present apparatus includes a support and a nozzle, which are adapted and configured to convey fluid to and to wash a drain. Typically, the drain washing apparatus includes a wand as the support and a ball or head as the nozzle. The present apparatus can also include a fluid retainer, which is adapted and configured to keep the dispensed fluid in and/or near the drain. Typically, the present apparatus include a shield as a fluid retainer.

Wand

In an embodiment, the drain washing apparatus includes wand 1 (see, e.g., FIGS. 1–4A and 4B). Wand 1 includes distal end 3 and proximal end 5. Distal end 3 can couple to the nozzle, such as ball 7 or head 9. Wand 1 is adapted and configured to provide fluid flow through or along the wand 1 to the nozzle. Fluid flow through wand 1 can be accomplished through a cavity, such as bore 11, defined by the wand 1. Fluid flow along wand 1 can be accomplished through, for example, hose 13 or tube 15 coupled to wand 1 (see, e.g., FIGS. 4A and 4B). Each of hose 13 and tube 15 define a lumen 17. Wand 1, hose 13, or tube 15 are coupled to the nozzle to provide fluid communication into and through the nozzle. For example, bore 11 or lumen 17 can open into a cavity or aperture in the nozzle.

Wand 1 can take any of a variety of configurations suitable for washing a drain. Wand 1 can be stiff or flexible, and can include one or more stiff segments and/or flexible segments. Wand 1 can also be straight, curved, or angled. Wand 1 can be sized so that an operator can stand and reach a drain in a sink, e.g., a wand about 12–24 inches long. Alternatively, wand 1 can be sized so that the operator can stand and reach a floor drain, e.g. a wand about 3–5 feet long.

In an embodiment, for a drain on a horizontal surface, wand 1 can be curved or angled at up to about 45°. Such a configuration can orient the nozzle (e.g., ball 7 or head 9) directly into the drain (e.g., perpendicular to the horizontal surface) and the proximal end 5 of wand 1 can be oriented for convenient grasping by the operator. Similarly, wand 1 can be angled to access a drain on a raised or angled surface or at the end of a rigid or flexible hose or line. Wand 1 can be angled to allow its proximal portion to be more nearly parallel to a floor to access a drain under equipment on short legs, wheels, or otherwise raised from the floor. For example, a 90° angle would keep the proximal portion of wand 1 parallel to the floor. An angle between 45° and 90° can also be employed to allow access under equipment.

In an embodiment, the segment of wand 1 adjacent to or coupled to the nozzle (nozzle coupling segment 19) can be flexible or can include a hinged segment. For example, dispenser coupling segment 19 can include two rigid segments joined by a bendable joint or hinge. The joint or hinge can be continuously variable through a range of angles or variable only to preselected angles, and can be reversibly fixed to a particular angle or unable to be fixed. Such a bendable joint or hinge can provide for an adjustable angle bend in wand 1 that can be fixed at a particular desired angle. By way of further example, dispenser coupling segment 19 can include a flex connection, which includes a flexible hose with an embedded or surrounding metal coil, such as hydraulic hose. The coil can provide impetus to urge the segment to straighten and can protect the flexible hose. Flex connections and other types of flexible segments suitable for fluid communication and wands are known and can be employed in the present apparatus.

In an embodiment, proximal end 5 of wand 1 can couple to a source of fluid. Suitable sources of fluid include a hose or a dispenser or diluter for the particular fluid applied with the present apparatus. Wand 1 can couple to a source of fluid employing a quick connect, a hose clamp, threads, a ball valve outlet, or the like. In an embodiment, wand 1 can couple to a source of fluid employing any suitable coupling mechanism that allows fluids to flow within the present apparatus, but provides a fluid-tight seal that prevents or minimizes leakage from between the source of fluid and proximal end 5. Wand 1 can couple to a source of fluid at any position and through any mechanism suitable for supplying liquid to the nozzle.

Wand 1 can be a single unitary wand 1 or can be made from reversibly mating subunits. For example, wand 1 can be made from two or three segments that couple in a known fluid tight fashion to provide a long wand made of shorter subunits. Using all or only some of the subunits can result in a variable length wand. Although not preferred, wand 1 can be telescoping to provide a wand 1 that can be used at variable lengths or made shorter for storage.

Wand 1 can be coupled to any of a variety of accessories that make wand 1 or the present apparatus more easily or broadly useable. For example, wand 1 can include or be coupled to a valve 21 that controls fluid flow through or along wand 1, e.g., through bore 11, hose 13, or tube 15. Valve 21 can be any type of valve suitable for controlling fluid flow through a hose, tube, or wand. In an embodiment, valve 21 is an on-off ball valve. Additional suitable valves include a trigger-controlled valve, a variable flow control valve, a check valve, an antisiphoning valve, a backflow-preventing valves or devices, an intermittent flow control valves, a valve that controls or attenuates pressure, or the like. Wand 1 can, alternatively, be coupled to a device that prepares, dilutes, heats, cools, and/or controls the flow of the fluid. Such devices include chemical aspirators, dispensers, foamers that add chemicals to the fluid flow, hose-end sprayers that siphon concentrates and dilute them with water at specified rates, booster heaters, coolers, flow restrictors, antisiphoning devices, valves, and the like.

In an embodiment, wand 1 is coupled to one or more handles 23. Handle 23 can be adapted and configured to provide the user a surer, more comfortable, more ergonomic, insulated, or the like grip on the drain washing apparatus. Handle 23 can surround the wand, can extend from the wand (e.g., like a pistol-grip), can be straight or contoured, and the like.

Nozzle

In an embodiment, the drain washing apparatus includes ball 7 or head 9 as the nozzle. The nozzle is adapted and configured to direct fluid into a drain and/or onto drain surfaces, such as the walls of the drain and/or the drain cup. Preferably, when the present apparatus is washing a drain, the nozzle directs substantially all of the fluid into the drain and/or onto drain surfaces without directing significant amounts of fluid outside the drain or outside the immediate surroundings of the drain. The nozzle is typically coupled to the distal end 3 of wand 1. The nozzle can include a cavity in fluid communication with bore 11 or lumen 17. The nozzle cavity can include or be in fluid communication with one or more openings for dispensing fluid into the drain or onto drain surfaces. Fluid can flow from bore 11 or lumen 17 into and through the nozzle cavity and out through the nozzle opening.

Ball

Figure 2A:
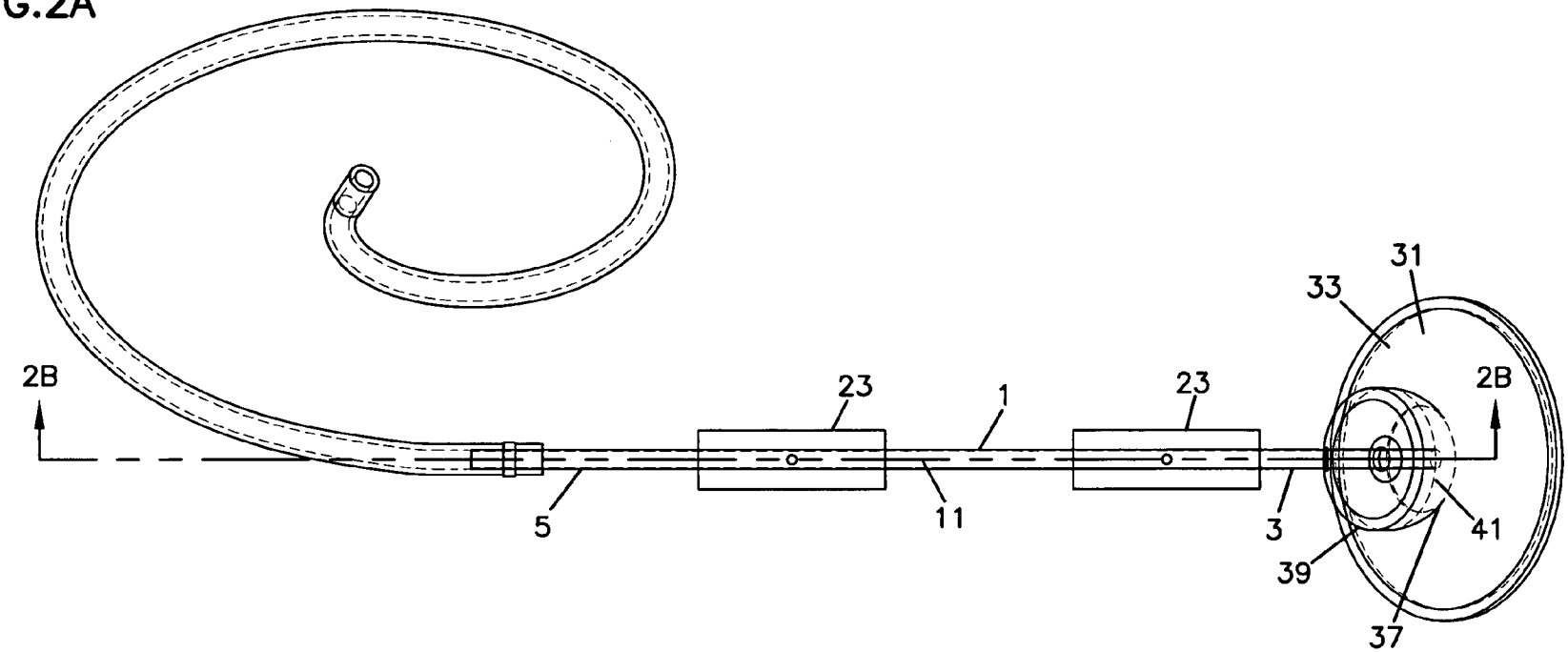
FIG. 2 illustrates an embodiment of a drain washing apparatus according to the present invention and including a wand, a ball, and a shield.
Figure 2B:
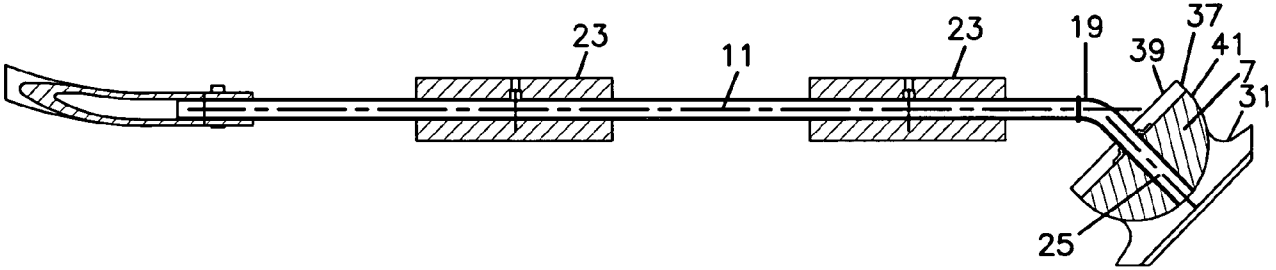

In an embodiment, the nozzle includes ball 7. Ball 7 can be coupled to the distal end 3 of wand 1. Ball 7 can define a cavity such as passage 25 in fluid communication with bore 11 or lumen 17 and with the surroundings of the present apparatus. Passage 25 can include or be in fluid communication with an opening, such as aperture 27. Ball 7 can define aperture 27. FIG. 1 illustrates an embodiment of an apparatus including ball 7, and FIG. 2 illustrates another.

In an embodiment, ball 7 includes a single passage 25 and aperture 27. Such a configuration is advantageous for directing fluid flow in a single general direction. In another embodiment, ball 7 includes a plurality of passages 25 and apertures 27. Typically, in such an embodiment, one passage 25 and aperture 27 is larger than the other or others. Such a configuration can direct a large portion of the fluid flow in one general direction and a minority of the fluid flow in one or more additional directions. Advantageously, passage(s)

25 and aperture(s) 27 are oriented in ball 7 to direct fluid into the drain, for example, along the axis of wand 1 or nozzle coupling segment 19.

Figure 5A:
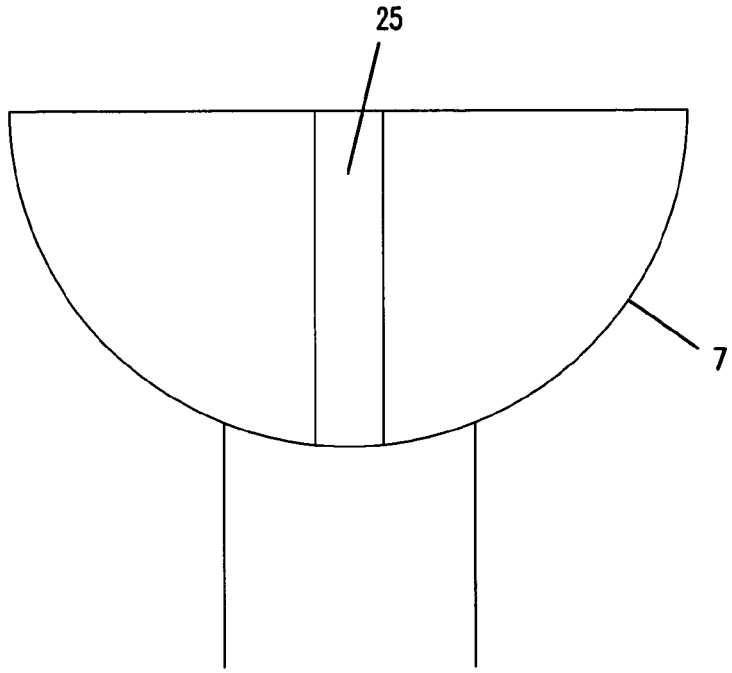
FIGS. 5A and 5B illustrates a ball with a round cross section nesting with an opening of a cylinder, such as a drain.
Figure 5B:
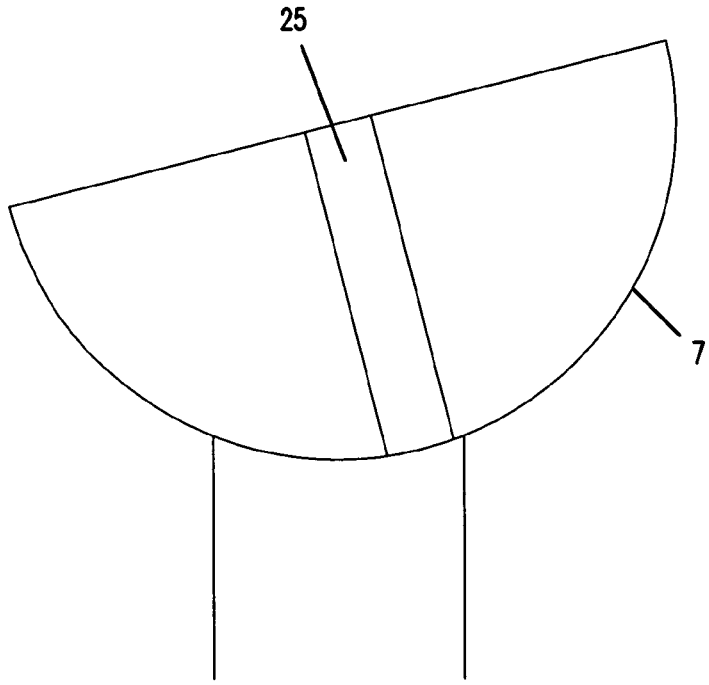

Ball 7 is adapted and configured to nest with a drain mouth. That is, ball 7 can include a circular cross section that can rest in and fill the mouth of a drain. For example, a half of a sphere of diameter larger than the diameter of the opening of a drain (or another circular opening) can fill that opening and, if the sphere and circular opening are perfect, contact the ertire rim of the opening (FIGS. 5A and 5B). If the half of a sphere is pierced by a cylindrical cavity, changing the orientation of the sphere relative to the opening changes the orientation of the cavity also (FIGS. 5A and 5B). In an embodiment, ball 7 nests with a drain mouth with a fit sufficiently clean or tight that little or no fluid gets out of the drain when the present apparatus washes the drain.

In an embodiment, ball 7 can be in the shape of half of a sphere, or another portion of a sphere suitable for resting in the mouth of a drain. Ball 7 can nest with a variety of drains smaller than the ball 7. For effective nesting, ball 7 is at least as large as the drain opening. In an embodiment, ball 7 has a size of at least about 1 to about 1.5 times the diameter of the drain opening. For example, for washing a drain with an opening diameter of about 3 inches, ball 7 can be a portion of a sphere having a diameter of at least about 3 to about 4.5 inches. For example, for washing a drain with an opening diameter of about 2 inches, ball 7 can be a portion of a sphere having a diameter of at least about 2 to about 3 inches. For example, for washing a drain with an opening diameter of about 6 inches, ball 7 can be a portion of a sphere having a diameter of at least about 6 to about 9 inches.

Ball 7 can have any of a variety of shapes suitable for presenting a circular cross section to the opening or rim of a drain. For example, ball 7 can have the shape of all or a portion of a hemisphere, an oblate sphere, an oblong sphere, an ellipsoid or elliptical solid (e.g., an egg-shaped solid), or the like. Advantageously, the diameter of the circular cross section of these shapes are dimensioned or selected like the diameters of ball 7 shaped like a portion of a sphere.

Ball 7 advantageously can present a round cross section to a round drain opening to provide a snug fit in the drain opening, which can keep fluid from the present apparatus, and other fluid already in the drain, from escaping the drain. For example, aerosols formed while washing the drain can largely be retained within the drain. In an embodiment, ball 7 can be adapted and configured to reduce, to minimize, or to stop "over-spray", which is an industry term for contamination caused by spraying a dirty area and having the contaminated spray, droplets, aerosolized solution, or the like dirty another previously cleaned area. Ball 7 is advantageously of a dimension that does not readily wedge into the drain. A round cross section, rounded perimeter, and a diameter larger than the drain facilitate removal of ball 7 from the drain.

In an embodiment, ball 7 can be constructed of material advantageous for nesting with a drain and/or for avoiding damage to or marking of surfaces around the drain. For example, ball 7 can include a resilient surface. Such a resilient surface is typically no more resilient than the surface of the toy known as a "super ball". That is, a hard rubber surface is considered a resilient surface. Such a hard rubber surface can provide a snug and, at least partially, sealing fit with the drain opening. In addition, hard rubber is unlikely to chip or break ceramic surfaces (e.g., floors or sinks) around the drain.

In an embodiment, ball 7 can couple to or near proximal end 5 of wand 1. Ball 7 can couple to wand 1 employing a quick connect, threads, friction (e.g., wand 1 impales ball 7), permanent bonding, one or more ribs, an O-ring, or the like. Ball 7 can couple to wand 1 at any position and through any mechanism suitable for dispensing liquid into a drain or onto a drain surface. Ball 7 can be coupled to wand 1 at a fixed orientation or, for example, with coupling that allows ball 7 to be moved angularly with respect to wand 1.

Head

Figure 3:
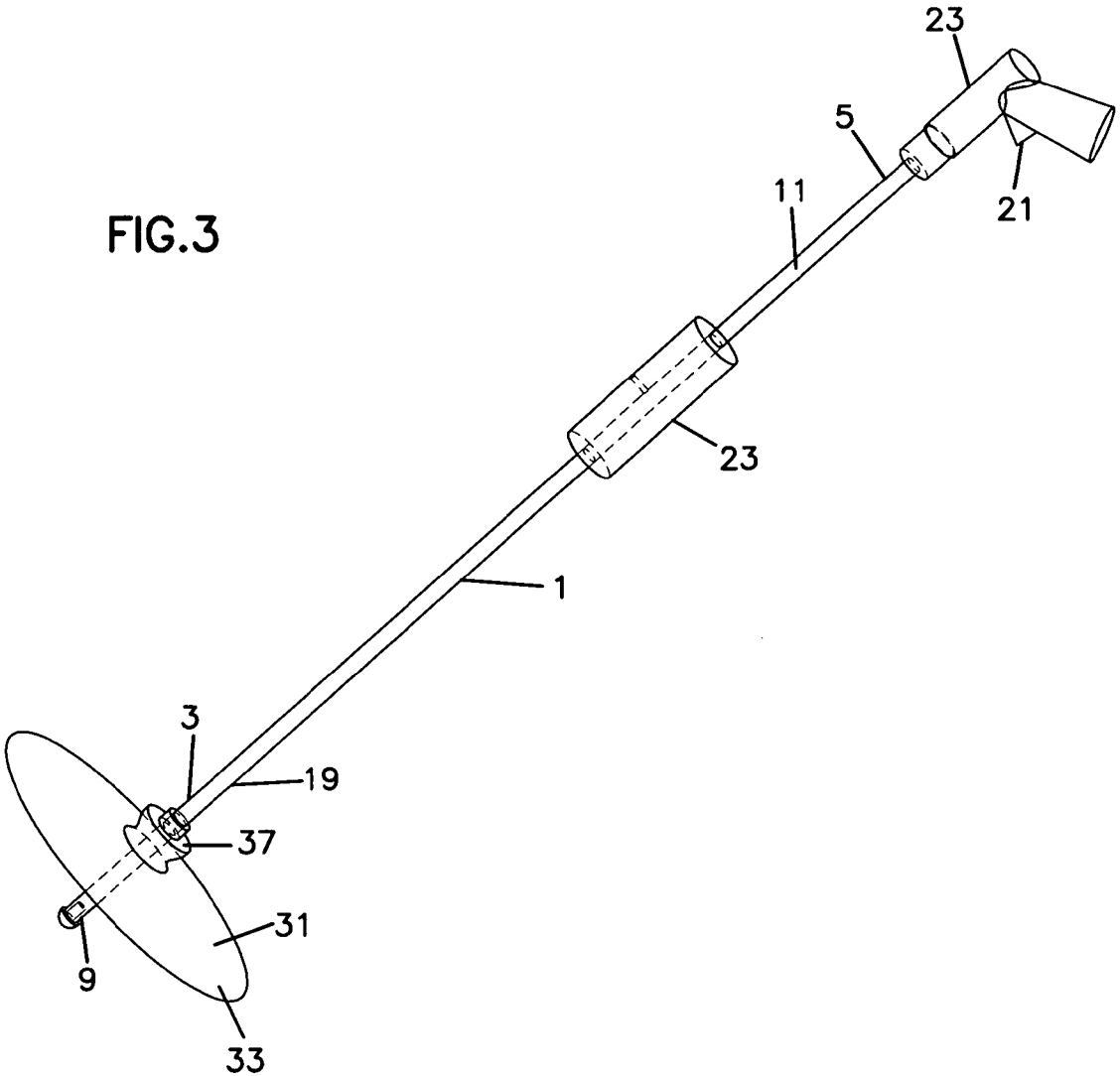
FIG. 3 illustrates an embodiment of a drain washing apparatus according to the present invention and including a wand, a head, and a shield.
Figure 4A:
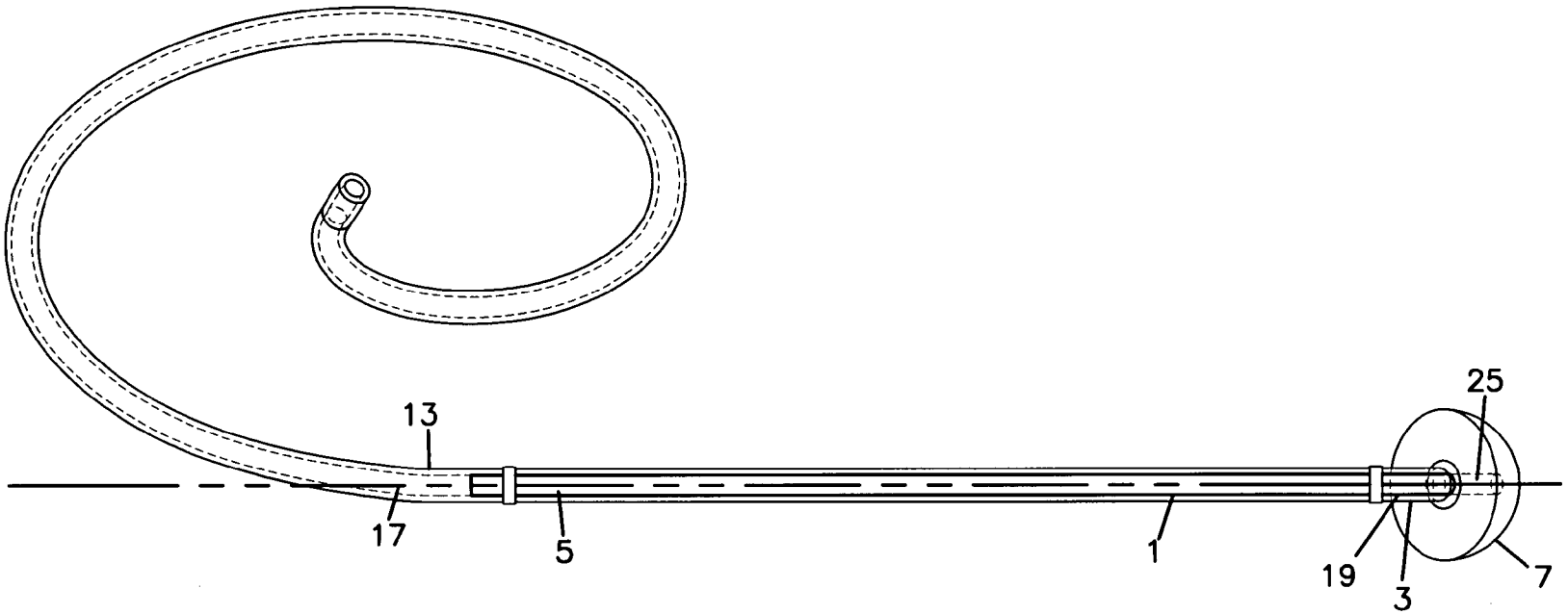
FIG. 4A illustrates an embodiment of a drain washing apparatus according to the present invention and including a hose.
Figure 4B:
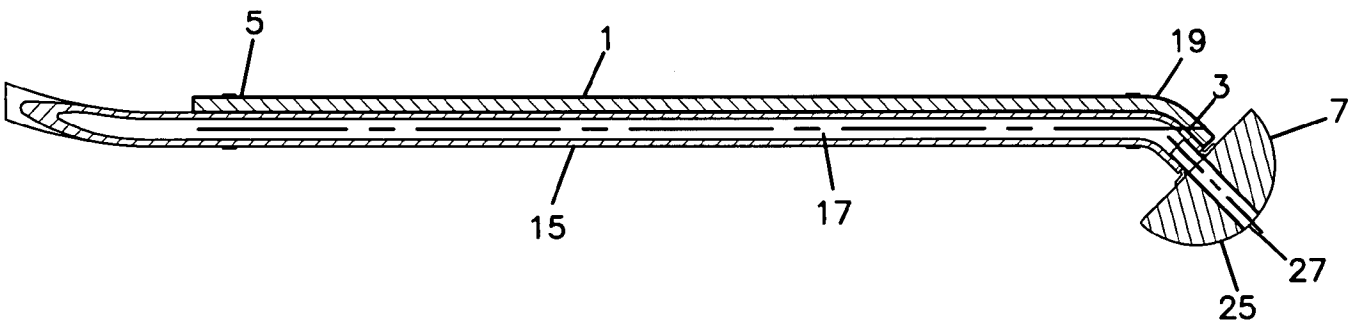
FIG. 4B illustrates an embodiment of a drain washing apparatus according to the present invention and including a tube.

In an embodiment, the nozzle includes head 9. Head 9 can be coupled to the distal end 3 of wand 1. Head 9 can define a cavity such as void 29 in fluid communication with bore 11 or lumen 17 and with the surroundings of the present apparatus. Void 29 can include or be in fluid communication with an opening, such as aperture 27. Head 9 can define aperture 27. FIG. 3 illustrates an embodiment of an apparatus including head 9.

Figure 6A:
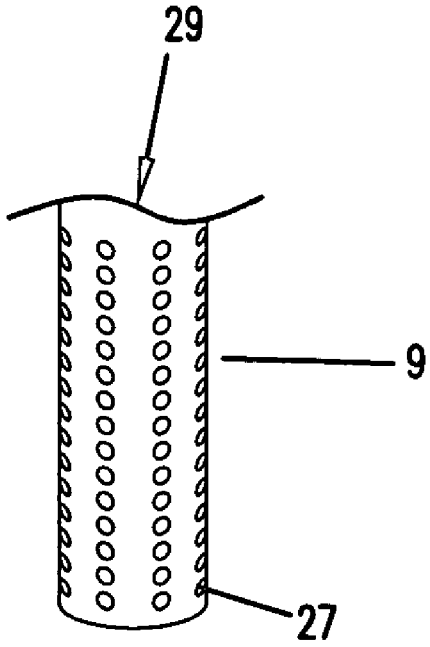
FIG. 6A illustrates an embodiment of a cylindrical head for a drain washing apparatus according to the present invention.
Figure 6B:
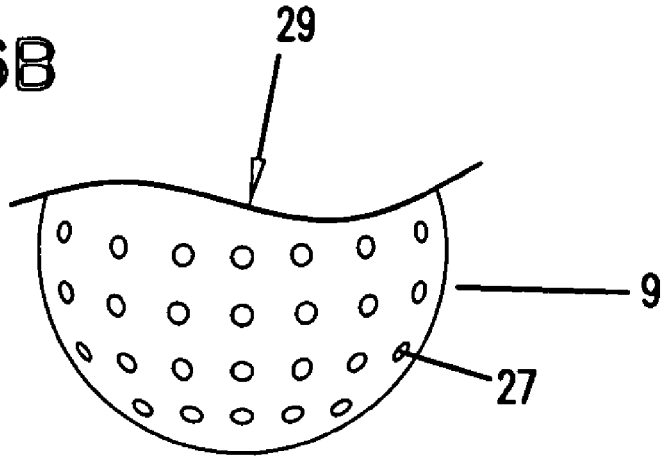
FIG. 6B illustrates an embodiment of a hemispherical head for a drain washing apparatus according to the present invention.

In an embodiment, head 9 includes a plurality of apertures 27. Each of the apertures can be about the same size. In an embodiment, head 9 is adapted and configured to fit into a drain or drain cup and for distributing fluid on the walls of the drain. Such a head 9 can be adapted and configured to direct fluid onto the drain wall all around head 9, for example, over a range of about 180°. For example, apertures 27 can be spread over nearly or about 180° of the surface of a head 9 shaped like sphere or a portion of a sphere, for example, a hemisphere. Alternatively, apertures 27 can be spread all around a cylindrical head 9. Suitable shapes for head 9 including hemisphere, oblong, cylindrical, bulb-shaped, shapes described above for ball 7, and the like. FIGS. 3 and 6A illustrate embodiments of hemispherical heads 9 and FIG. 6B illustrates an embodiment of a hemispherical head.

In an embodiment, head 9 can couple to or near proximal end 5 of wand 1. Head 9 can couple to wand 1 employing a quick connect, threads, friction (e.g., wand 1 impales head 9), permanent bonding, or the like. Head 9 can couple to wand 1 at any position and through any mechanism suitable for dispensing liquid into a drain or onto a drain surface. Head 9 can be coupled to wand 1 at a fixed orientation or, for example, with coupling that allows head 9 to be moved angularly with respect to wand 1.

Fluid Retainer

In an embodiment, the drain washing apparatus includes a fluid retainer, such as shield 31. The fluid retainer can be adapted and configured to separate the drain from its surroundings when the present apparatus is washing the drain. For example, the fluid retainer can present cross section greater than the diameter of the drain. Such a fluid retainer can be, for example, shaped like a cone, cymbal, or other effective configuration for retaining fluid near or in the drain. In embodiments, the fluid retainer can be adapted and configured to reduce, to minimize, or to stop "over-spray", which is an industry term for contamination caused by spraying a dirty area and having the contaminated spray, droplets, aerosolized solution, or the like dirty another previously cleaned area. The fluid retainer can be positioned on or surrounding the wand near the distal end but proximal of the nozzle and extend radially from the nozzle. The fluid retainer can define a cavity that at least partially houses the nozzle. The nozzle can be oriented to direct fluid in a direction generally away from or parallel to the fluid retainer.

In an embodiment, the fluid retainer includes shield 31. Shield 31 can be adapted and configured to separate the drain from its surroundings when the present apparatus is washing the drain. For covering and extending beyond the drain, shield 31 can be coupled to wand 1 at the distal end 3 and proximal from the nozzle, e.g. ball 7 or head 9. Such a shield 31 can extend radially from wand 1 and can have a radial dimension greater than a diameter of a drain. FIG. 2 illustrates an embodiment of an apparatus including shield 31, and FIG. 3 illustrates another.

Shield 31 can cover and extend beyond the drain and have a any of a variety of shapes suitable for doing so. Shield 31 advantageously can cover a drain to keep fluid from the present apparatus, and other fluid already in the drain, from escaping the drain during washing. For example, aerosols formed while washing the drain can largely be retained within the drain. Suitable shapes for shield 31 include conical, a shape resembling a cymbal, dome or bell shaped, or the like. Shield 31 can have a shape with a radius, diameter, or round cross section. In certain embodiments, shield 31 can have a square or other cross section, a pyramidal shape, or a "half-pipe" shape. A half pipe shape can be advantageous for use with trough drains.

Shield 31 can cover a variety of drains smaller than shield 31. For effective coverage, shield 31 is at least as large as the drain opening. In an embodiment, shield 31 has a diameter or radial dimension of about 1.2 times the diameter of the largest drain it is designed to cover. For example, for washing a drain with an opening diameter of about 3 inches, shield 31 can have a diameter or radial dimension of at least about 3.6 or about 4 inches. For example, for washing a drain with an opening diameter of about 6 inches, shield 31 can have a diameter or radial dimension of at least about 7 or about 8 inches. For example, for washing a drain with an opening diameter of about 12 inches, shield 31 can have a diameter or radial dimension of at least about 14 or about 15 inches.

In an embodiment, shield 31 can be coupled to and can contact wand 1 and can be adapted and configured to contact the surface surrounding the drain. The portion of shield 31 adapted and configured to contact the surface surrounding the drain is the contact portion 33 of shield 31. Contact portion 33 can, for example, be a rim or edge of a conical shield 31 or cymbal shaped shield 31.

In an embodiment, shield 31 can also include contact seal 35. Contact seal 35 can be adapted and configured to retain fluid between the shield and a surface surrounding the drain. Contact seal 35 can, for example, be coupled to contact portion 33 of shield 31. Contact seal 35 can be resilient. Advantageously, contact seal 35 is sufficiently resilient to at least partially conform to grooves (e.g., in grout), seams, edges, dents, chips, indentations in floor tile or drain perimeter, or other deviations from planarity in the surface around the drain.

In an embodiment, shield 31 defines a cavity or housing proximal to and at least partially occupied by the nozzle, e.g., ball 7 or head 9. For example, shield 31 can define a cavity proximal the nozzle and include a contact portion spaced radially from the nozzle. For a cymbal shaped or conical shield 31, the cavity can be centrally located on the cymbal shape or the cone. The nozzle, particularly head 9, can extend below shield 31, for example, along the axis of wand 1 or nozzle coupling segment 19.

Shield housing 37 can provide more than just a space or cavity to be occupied by the nozzle, e.g. ball 7 or head 9. Shield housing 37 can be adapted and configured to retain the nozzle within the housing, that is, to house the nozzle, in particular ball 7. For example, shield housing 37 can include one or more flanges 39 and cylinder 41. The nozzle can be retained in cylinder 41 by friction, by constraints of the coupling of shield 31 to wand 1, or by flange 39.

In an embodiment, cylinder 41 can define defining a cavity occupied by at least a portion of the nozzle and having a proximal end and distal end. Flange 39 can be positioned at or near the proximal end of cylinder 41 and retain fluid under shield 31 and nozzle (e.g., ball 7) within cylinder. For example, flange 39 can surround at least a portion of the proximal end of the cylinder and be adapted and configured to prevent the nozzle (e.g., ball 7) from protruding through the proximal end of the cylinder. Shield housing 37 can also include a seal located between flange 39 and the nozzle (e.g., ball 7).

Shield 31 can be made from any material suitable for making a fluid retainer. Advantageously, shield 31 can be made from a durable material, such as metal (e.g., stainless steel), a hard plastic or resin, or the like. In an embodiment, a shield made from a durable material is made from a material that will not corrode or otherwise break down after prolonged or repeated contact with the cleaning compositions used for washing drains or the content of the drain. Preferably, the durable material is rigid and/or malleable but can also be resilient. The shield can be sufficiently resilient to conform to minor pits and grooves in the surface surrounding the drain, but is generally no more resilient than hard rubber. Preferably, shield 31 is not floppy like a rag or thin sheet of material from a plastic bag.

Shield 31 can be coupled to wand 1 and/or the nozzle by any suitable or conventional mechanism for doing so. For example, wand 1 can protrude through a hole in the center of shield 31 and shield 31 can be prevented from falling off distal end 3 wand 1 by a nozzle having a radial dimension bigger than the hole in the shield. Alternatively, shield 31 can be coupled to wand 1 by a collar or other mechanism, fixed or allowing shield 31 movement, or allowing movement of nozzle and/or wand, but not the shield, relative to the drain and surrounding surface. Shield 31 can be coupled to wand 1 by a mechanism such as threads, a grooved fitting on wand 1 into which fits an edge of shield 31, or the like. In an embodiment, a preferred coupling mechanism includes a quick connect/disconnect that does not swivel or turn. Shield 31 can be coupled to nozzle coupling segment 19 or wand 1.

Shield 31 can be adapted and configured for convenient placement of the present apparatus on a drain. For example, in a configuration for washing a floor drain, shield 31 can include a foot rest, adapted and configured to allow the operator to use the weight of the operator's body to retain the present apparatus on the drain. The foot rest can be as little as a flat protrusion from shield 31.

Additional Components

The drain washing apparatus can include other components that can be useful for washing a drain. For example, the present apparatus can include a component that dilutes or dispenses a fluid into the fluid flowing through the apparatus. Such a diluter or dispenser can dispense or dilute a cleaning composition, an antimicrobial composition, or the like.

In an embodiment, an apparatus including head 9 can also include a brush (not shown). The brush can extend axially from distal end 3 of wand 1 or from head 9. The brush can be positioned to be irrigated by fluid from head 9. The brush can be dimensioned so its bristles contact the walls of the drain or drain cup.

It should be noted that, as used in this specification and the appended claims, the singular forms "a," "an," and "the" include plural referents unless the content clearly dictates otherwise. Thus, for example, reference to an apparatus including "a handle" includes an apparatus with two or more handles. It should also be noted that the term "or" is generally employed in its sense including "and/or" unless the content clearly dictates otherwise.

It should also be noted that, as used in this specification and the appended claims, the phrase "adapted and configured" describes a system, apparatus, or other structure that is constructed or configured to perform a particular task or adopt a particular configuration. The phrase "adapted and configured" can be used interchangeably with other similar phrases such as arranged and configured, constructed and arranged, adapted, constructed, manufactured, manufactured and arranged, and the like.

The invention has been described with reference to various specific and preferred embodiments and techniques. However, it should be understood that many variations and modifications may be made while remaining within the spirit and scope of the invention.

We claim:

1. A drain washing apparatus comprising ball, shield, and wand;

the wand having proximal end and distal end;

the ball being coupled to the wand at the distal end;

the wand and ball being adapted and configured to provide fluid flaw through or along the wand and through the ball;

the ball being adapted and configured to nest with a drain;

the shield being coupled to the wand at the distal end and proximal of the ball;

the shield extending radially from the wand; and the shield having a radial dimension greater than a diameter of a drain;

wherein the shield defines a cavity proximal the ball and comprises a contact portion spaced radially from the ball;

wherein the shield comprises housing, the housing being adapted and configured to retain the ball;

wherein the housing comprises cylinder and flange:

the cylinder defining a cavity occupied by at least a portion of the ball and having a proximal end and distal end;

the flange surrounding at least a portion of the proximal end of the cylinder and being adapted and configured to prevent the ball from protruding through the proximal end of the cylinder.

2. The apparatus of claim 1, wherein the shield is shaped like a cymbal, the cavity being centrally located on the cymbal shape.

3. The apparatus of claim 1, comprising a conical shield.

4. The apparatus of claim 1, the shield further comprising contact seal, the contact seal being resilient and adapted and configured to retain fluid between the shield and a surface.

5. The apparatus of claim 1, wherein the shield comprises metal.

6. The apparatus of claim 1, wherein the shield comprises resilient material.

7. The apparatus of claim 1, further comprising a diluter for a cleaning composition in fluid communication with the wand and ball.

8. The apparatus of claim 1, wherein the ball defines a circular cross section.

9. The apparatus of claim 8, wherein the ball is shaped as a hemisphere, an oblate sphere, an oblong sphere, or an elliptical solid.

10. The apparatus of claim 1, wherein the ball comprises a resilient surface.

11. The apparatus of claim 1, further comprising a seal located between the flange and the ball.

12. A drain washing apparatus comprising ball, shield, and wand;

the wand having proximal end and distal end;

the ball being coupled to the wand at the distal end;

the wand and ball being adapted and configured to provide fluid flow through or along the wand and through the ball;

the ball being adapted and configured to nest with a drain;

the shield being coupled to the wand at the distal end and proximal of the ball;

the shield extending radially from the wand; and the shield having a radial dimension greater than a diameter of a drain;

wherein the shield comprises housing, the housing being adapted and configured to retain the ball;

wherein the housing comprises cylinder and flange;

the cylinder defining a cavity occupied by at least a portion of the ball and having a proximal end and distal end;

the flange surrounding at least a portion of the proximal end of the cylinder and being adapted and configured to prevent the ball from protruding through the proximal end of the cylinder.

13. The apparatus of claim 12, further comprising a seal located between the flange and the ball.

14. The apparatus of claim 12, further comprising a diluter for a cleaning composition in fluid communication with the wand and ball.

15. The apparatus of claim 12, wherein the ball defines a circular cross section.

16. The apparatus of claim 15, wherein the ball is shaped as a hemisphere, an oblate sphere, an oblong sphere, or an elliptical solid.

17. The apparatus of claim 12, wherein the ball comprises a resilient surface.

18. The apparatus of claim 12, wherein the shield:

is coupled to the wand at the distal end and proximal of the ball;

extends radially from the wand; and has a radial dimension greater than a diameter of a drain.

19. The apparatus of claim 18, wherein the shield defines a cavity proximal the ball and comprises a contact portion spaced radially from the ball.

20. The apparatus of claim 19, wherein the shield is shaped like a cymbal, the cavity being centrally located on the cymbal shape.

21. The apparatus of claim 18, the shield further comprising contact seal, the contact seal being resilient and adapted and configured to retain fluid between the shield and a surface.

22. The apparatus of claim 18, wherein the shield comprises metal.

23. The apparatus of claim 18, wherein the shield comprises resilient material.

24. A drain washing apparatus comprising head, shield, and wand;

the wand having proximal end and distal end;

the head being coupled to the wand at the distal end;

the wand and head being adapted and configured to provide fluid flow through or along the wand and through the head;

the shield being coupled to the wand at the distal end and proximal of the ball;

the shield extending radially from the wand;

the shield having a radial dimension greater than a diameter of a drain;

wherein the shield defines a cavity proximal the head and comprises a contact portion spaced radially from the head;

wherein the shield comprises housing, the housing being adapted and configured to house, the head;

wherein the housing comprises cylinder and flange;

the cylinder defining a cavity occupied by at least a portion of the head and having a proximal end and distal end;

the flange surrounding at least a portion of the proximal end of the cylinder and being adapted and configured to prevent the head from protruding through the proximal end of the cylinder.

25. The apparatus of claim 24, wherein the head defines apertures; the apertures being configured to provide fluid dispersion through 180 degrees.

26. The apparatus of claim 25, wherein the head comprises a hemispherical surface with apertures distributed across the surface.

27. The apparatus of claim 25, wherein the apertures are all the same size.

28. The apparatus of claim 24, wherein the shield is shaped like a cymbal, the cavity being centrally located on the cymbal shape.

29. The apparatus of claim 24, the shield further comprising contact seal, the contact seal being resilient and adapted and configured to retain fluid between the shield and a surface.

30. The apparatus of claim 24, wherein the shield comprises metal.

31. The apparatus of claim 24, wherein the shield comprises resilient material.

32. The apparatus of claim 24, further comprising a diluter for a cleaning composition in fluid communication with the wand and head.

33. The apparatus of claim 24 further comprising a brush, the brush extending axially from the distal end of the wand, the brush positioned to be irrigated by fluid from apertures.

34. The apparatus of claim 24, further comprising a seal located between the flange and the head.

* * * * *